US012129073B2

(12) United States Patent
Bouteloup et al.

(10) Patent No.: US 12,129,073 B2
(45) Date of Patent: Oct. 29, 2024

(54) ASSEMBLY COMPOSED OF A CONTAINER FOR A FLUID AND A DISPENSER PACKAGING

(71) Applicant: CORADIN SAS, Mouans-Sartoux (FR)

(72) Inventors: David Bouteloup, Le Tignet (FR); Fabrice Bourdier, Montauroux (FR); Florence Bidamant, Mulhouse (FR)

(73) Assignee: CORADIN SAS, Mouans-Sartoux (FR)

( * ) Notice: Subject to any disclaimer, the term of this patent is extended or adjusted under 35 U.S.C. 154(b) by 30 days.

(21) Appl. No.: 17/926,838

(22) PCT Filed: May 19, 2021

(86) PCT No.: PCT/FR2021/050891

§ 371 (c)(1),
(2) Date: Nov. 21, 2022

(87) PCT Pub. No.: WO2021/245337

PCT Pub. Date: Dec. 9, 2021

(65) Prior Publication Data

US 2023/0192346 A1 Jun. 22, 2023

(30) Foreign Application Priority Data

May 27, 2020 (FR) ..... 2005597

(51) Int. Cl.
*B65D 1/09* (2006.01)
*B65D 1/02* (2006.01)
(Continued)

(52) U.S. Cl.
CPC ..... *B65D 1/095* (2013.01); *B65D 1/0238* (2013.01); *B65D 41/023* (2013.01);
(Continued)

(58) Field of Classification Search
CPC .... B65D 1/095; B65D 1/0238; B65D 41/023; B65D 41/0414; B65D 41/0421;
(Continued)

(56) References Cited

U.S. PATENT DOCUMENTS 579,135 A * 3/1897 Cooper ..... B43K 5/04 222/215
1,775,400 A * 9/1930 Kramer ..... G02C 13/006 222/206

(Continued)

FOREIGN PATENT DOCUMENTS

JP S5794409 A 6/1982
JP H0199476 A 4/1989

OTHER PUBLICATIONS

International Search Report for International Application No. PCT/FR2021/050891 (Oct. 20, 2021).

*Primary Examiner* — Chun Hoi Cheung
*Assistant Examiner* — Brijesh V. Patel
(74) *Attorney, Agent, or Firm* — Jenkins, Taylor & Hunt, P.A.

(57) ABSTRACT

The present invention relates to an assembly composed of a container for a fluid and a dispenser packaging which makes it possible to receive said container and envelop it, at least partially, said container comprising a dispenser and at least one flexible wall, the container being suitable for dispensing said fluid by means of the dispenser by deforming said at least one flexible wall, the dispenser packaging being suitable so that at least part of said at least one flexible wall is accessible from outside of said dispenser packaging when the container is placed inside said dispenser packaging.

9 Claims, 4 Drawing Sheets

(51) Int. Cl.
*B65D 41/02* (2006.01)
*B65D 41/04* (2006.01)
*B65D 47/10* (2006.01)
*B65D 83/00* (2006.01)

(52) U.S. Cl.
CPC ..... *B65D 41/0414* (2013.01); *B65D 41/0421* (2013.01); *B65D 47/106* (2013.01); *B65D 83/0094* (2013.01); *B65D 2251/0015* (2013.01); *B65D 2251/0056* (2013.01); *B65D 2251/0093* (2013.01)

(58) Field of Classification Search
CPC ..... B65D 47/106; B65D 83/0094; B65D 2251/0015; B65D 2251/0056; B65D 2251/0093
USPC ..... 206/222, 219; 215/40; 222/105, 183, 222/182, 94, 129, 325, 207, 420; 132/320, 74.5, 75, 112, 317; 220/23.87, 220/23.89, 23.91
See application file for complete search history.

(56) References Cited

U.S. PATENT DOCUMENTS 2,568,286 A * 9/1951 Littlefield ..... B65D 35/28 222/103
3,223,289 A * 12/1965 Bouet ..... B05B 11/00446 401/153
3,224,650 A * 12/1965 Willits, Jr. ..... G01F 11/282 222/207
3,272,391 A * 9/1966 Meshberg ..... B65D 83/345 222/509
3,366,284 A * 1/1968 Marona ..... G01F 11/082 222/215
3,454,196 A * 7/1969 Hazard ..... B65D 51/222 D9/449
3,549,055 A * 12/1970 Gatland ..... A61M 15/009 222/509
3,704,819 A * 12/1972 Lindstrom ..... B65D 47/128 222/546
3,838,796 A * 10/1974 Cohen ..... B65D 83/0077 222/105
4,067,499 A * 1/1978 Cohen ..... A61M 11/007 239/323
4,177,939 A * 12/1979 Thomas ..... B65D 35/28 222/153.13
4,279,527 A * 7/1981 Moe ..... A45D 34/042 401/277
4,370,989 A * 2/1983 Taylor ..... A45D 34/042 401/268
4,457,454 A * 7/1984 Meshberg ..... B05B 11/1066 222/207
4,465,183 A * 8/1984 Saito ..... B65D 81/3211 215/DIG. 8
4,634,023 A * 1/1987 Tanaka ..... B65D 47/18 222/105
4,748,990 A * 6/1988 Brown ..... A45D 34/042 401/277
4,958,748 A * 9/1990 Otake ..... B43M 11/08 401/161
5,052,589 A * 10/1991 O'Meara ..... B67B 7/24 215/257
5,060,791 A * 10/1991 Zulauf ..... B65D 81/3222 222/129
5,137,178 A * 8/1992 Stokes ..... B65D 35/22 D9/695
5,261,571 A * 11/1993 Goncalves ..... G01F 11/082 222/541.6
5,388,726 A * 2/1995 Otake ..... B65D 83/0094 222/83
5,462,200 A * 10/1995 Weiler ..... B65D 51/222 222/90
5,586,694 A * 12/1996 Breidenbach ..... A45D 34/02 401/214
5,650,180 A * 7/1997 Kumada ..... B65D 83/0005 222/105
5,673,822 A * 10/1997 Chalmin ..... A61F 9/0008 222/183
5,934,457 A 8/1999 Ueda et al.
6,315,165 B1 * 11/2001 Regan ..... B65D 47/122 222/103
6,328,040 B1 * 12/2001 Stein ..... A45D 40/04 132/74.5
6,336,571 B1 * 1/2002 Chibret ..... A61F 9/0008 222/189.09
6,945,419 B2 * 9/2005 Bertazza ..... A45D 40/265 220/23.91
7,237,975 B2 * 7/2007 Noguchi ..... A45D 34/042 401/277
7,445,135 B2 * 11/2008 Miyata ..... B05C 17/00516 222/326
7,503,909 B2 * 3/2009 Kusu ..... A61F 9/0008 604/298
7,798,368 B2 * 9/2010 Anderson ..... B05B 11/1056 128/203.14
7,854,352 B2 * 12/2010 Davies ..... B05B 11/0032 128/203.14
8,002,135 B2 * 8/2011 Tanaka ..... B65D 47/06 206/441
8,038,034 B2 * 10/2011 Pelfrey ..... B05B 11/1032 222/207
8,147,461 B2 * 4/2012 Bonney ..... B05B 11/1059 604/246
8,162,161 B2 * 4/2012 Suzuki ..... B65D 51/225 215/334
8,328,775 B2 * 12/2012 Gokhale ..... A61F 9/0026 604/298
8,333,303 B2 * 12/2012 Dubach ..... B05B 11/048 222/95
8,397,926 B2 * 3/2013 Driver ..... A61J 9/001 215/11.1
8,714,407 B2 * 5/2014 Frank ..... B65D 35/28 222/105
8,752,732 B2 * 6/2014 Evans ..... F04B 43/08 222/207
9,266,381 B2 * 2/2016 Yen ..... B43L 19/0018
2002/0190079 A1 * 12/2002 Hamamoto ..... B65D 1/0215 222/481.5
2004/0074925 A1 * 4/2004 Faurie ..... A61F 9/0008 222/212
2005/0072442 A1 * 4/2005 Licari ..... A61Q 5/10 401/196
2006/0198686 A1 * 9/2006 Hetzel ..... A45D 34/00 401/47
2007/0119862 A1 * 5/2007 Backes ..... B65D 81/3266 222/107
2007/0145076 A1 * 6/2007 Yamada ..... A61F 9/0008 222/189.09
2007/0186950 A1 * 8/2007 Roeder ..... A46B 1/00 132/320
2009/0179031 A1 7/2009 Chen
2011/0309083 A1 * 12/2011 Hsiu-Tzu Charlene ..... A45D 34/00 206/459.5
2014/0246343 A1 * 9/2014 Sebille ..... B65D 1/40 206/222
2016/0081391 A1 * 3/2016 Zahr ..... B65D 77/0453 206/268
2018/0319566 A1 * 11/2018 Pan ..... B65D 1/0207
2020/0156851 A1 * 5/2020 Bidamant ..... B65D 83/0094
2021/0047085 A1 * 2/2021 Jin ..... A45D 40/00

* cited by examiner

[Fig. 1]
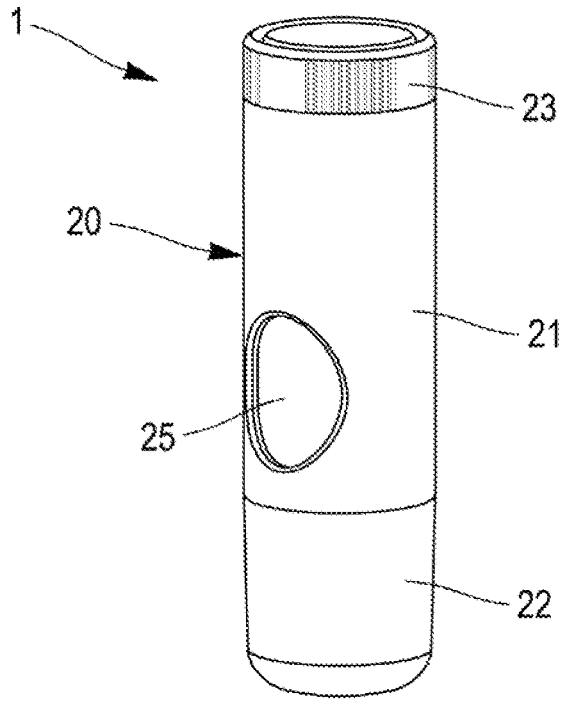
[Fig. 2]
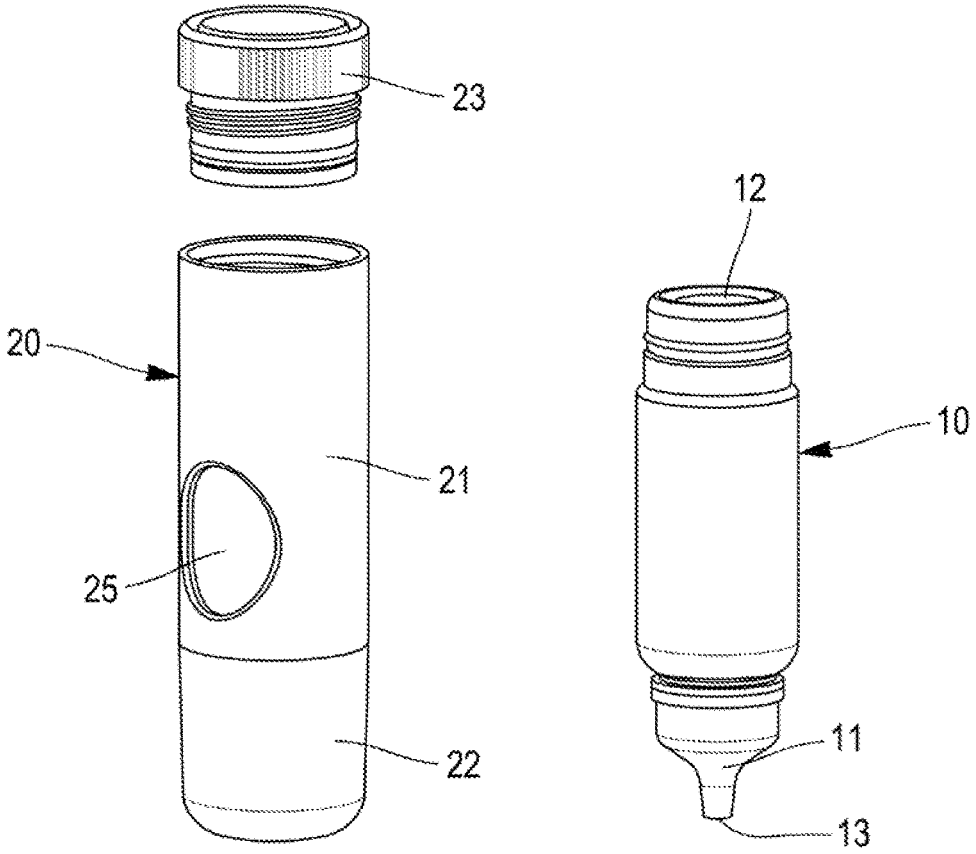

[Fig. 3]
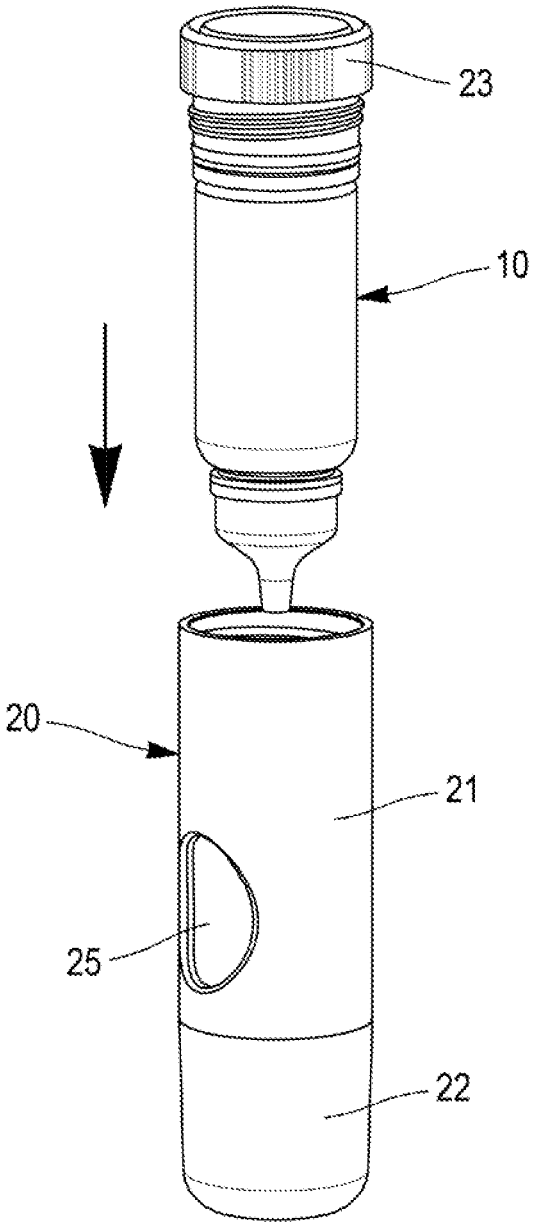

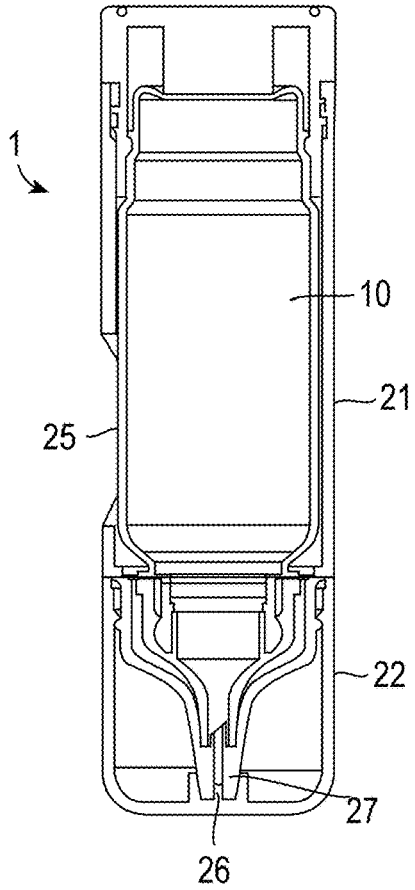
[FIG. 4]
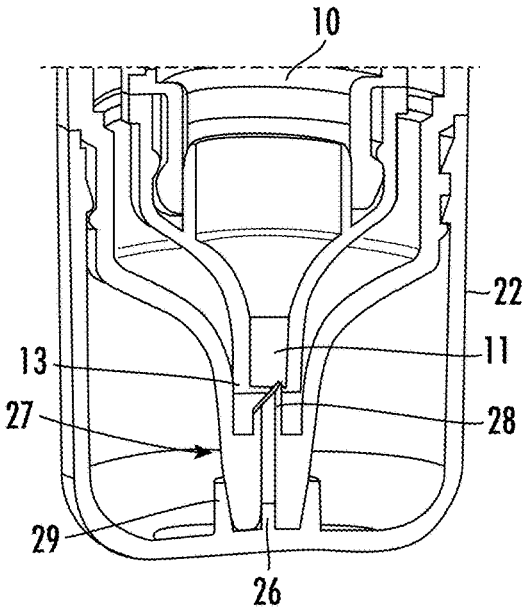
[FIG. 5]

[Fig. 6]
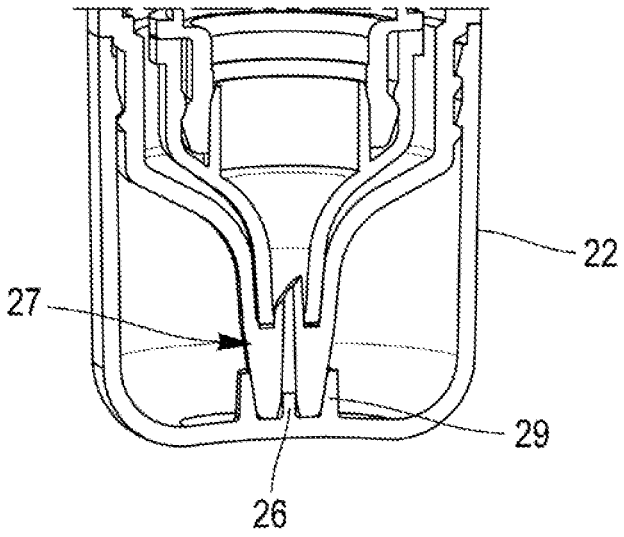
[Fig. 7]
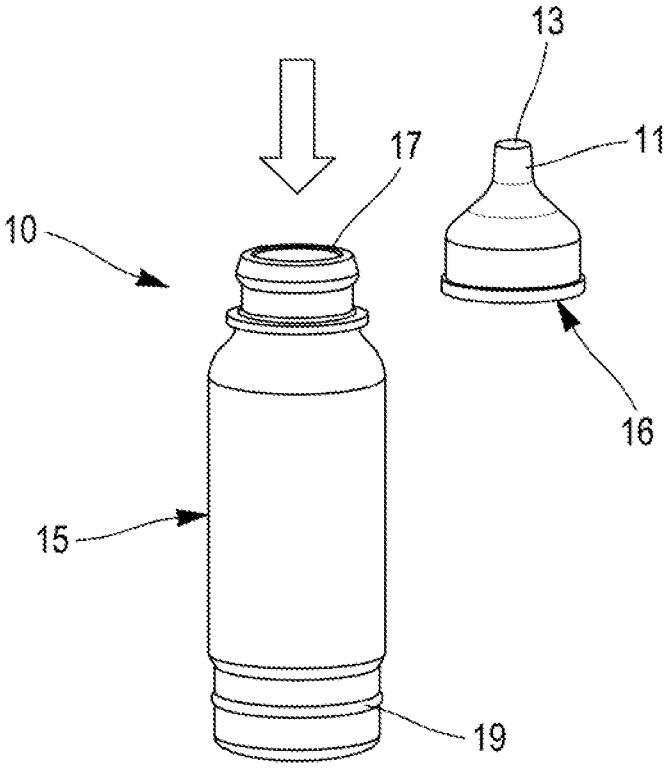

ASSEMBLY COMPOSED OF A CONTAINER FOR A FLUID AND A DISPENSER PACKAGING

FIELD OF THE INVENTION

The invention relates to an assembly composed of a container for a fluid and a dispenser packaging which makes it possible to receive said container and to envelop it, at least partially, said container comprising a dispenser and at least one wall made of a flexible material, the container being suitable for dispensing said fluid by means of the dispenser by deforming said at least one flexible wall, the dispenser packaging being suitable so that at least part of said at least one flexible wall is accessible from outside of said dispenser packaging when the container is placed inside said dispenser packaging.

BACKGROUND

In the prior art, it is known to use dispensers made using a flexible material which makes it possible to envelop and dispense fluids. Such dispensers are essentially in the form of a cylinder comprising a first end equipped with a dispenser, and a sealed second end. As a general rule, said container dispenser is sealed by means of a breakable closing element. Prior to using it, the user can remove the closing element with his/her fingers in order to release the dispenser from the container. By deforming the container, the user can dispense the fluid contained inside the container, by means of the dispenser.

A container of this type is often used in the pharmaceutical and cosmetics fields, and is also known by the term uni-dose.

The use of a uni-dose offers the advantage of enveloping a fluid in a hygienic manner. Said fluid is enveloped hermetically before use and is only released when the user breaks off the breakable element. Conversely, the uni-dose presents a disadvantage. Indeed, once the uni-dose has been opened, the user is forced to use the whole contents at the time of opening. The prior art refers to uni-doses whose breakable closing element may be returned to its starting position on the dispenser, thus acting as a plug and enabling later use of the remainder of the container's contents.

A first disadvantage of the solutions known from the prior art is the fact that sealing a dispenser using a breakable element which has already been removed is not simple, as the user is forced to reposition the closing element on the dispenser. As the dispenser is made of a flexible material, it is difficult to ensure that it is sealed.

Furthermore, as the user uses his/her fingers to remove the breakable element from the dispenser, the hygiene of the dispenser during the replacement of the breakable element onto the dispenser is not guaranteed. This constitutes a second disadvantage of the solutions known from the prior art. In other words, the dispenser may actually be contaminated by residue of foreign matter on the dispenser.

Another disadvantage of the use of a uni-dose, according to the prior art, is the fact that the breakable element forms an element which is separated from the rest of the packaging once the uni-dose has been opened. This means that it is necessary to remove and dispose of the breakable element. If there is no litter bin available nearby, an element of such a small size may thus end up littering the environment. For the reasons set out above, there is a need to propose novel solutions enabling use of containers composed of a flexible material in a manner more suitable for the pharmaceutical and cosmetics fields.

SUMMARY

The object of the present invention relates to an assembly composed of a container for a fluid and a dispenser packaging which makes it possible to receive said container and envelop it, at least partially, said container comprising a dispenser and at least one flexible wall, the container being suitable for dispensing said fluid by means of the dispenser by deforming said at least one flexible wall, the dispenser packaging being suitable so that at least part of said at least one flexible wall is accessible from outside of said dispenser packaging when the container is placed inside said dispenser packaging, wherein the dispenser packaging comprises at least a first element, suitable for partially enveloping the container whereas the container dispenser remains free to enable the fluid to be dispensed from the dispenser, and a second element suitable for sealing the dispenser of the container, said second element of the dispenser packaging being suitable to be fixed onto the first element of said dispenser packaging.

According to one embodiment of the invention, the second element of the dispenser packaging is in the form of a plug.

According to one embodiment of the invention, the interior of the perforating tip comprises a sealing piece suitable for sealing the container dispenser.

According to one embodiment of the invention, the first element of the dispenser packaging comprises an element for surrounding the container dispenser, wherein said container dispenser is equipped with a perforable sealing element and wherein the element for surrounding said dispenser comprises a striker suitable for perforating said perforable sealing element.

According to one embodiment of the invention, the container is essentially in the form of a cylinder.

According to one embodiment of the invention, the first element of the dispenser packaging is essentially in the form of a cylinder, equipped with a first end which is essentially open in order to allow the container to be introduced into said first element and a second end suitable for making the dispenser protrude from the first element.

According to one embodiment of the invention, the second element of the dispenser packaging comprises a sealing element suitable for sealing said first end once the container has penetrated the dispenser packaging.

According to one embodiment of the invention, the container comprises, at its end opposite the dispenser, at least one protrusion which makes it possible to facilitate the extraction of said container from the dispenser packaging after it has been used.

According to one embodiment of the invention, the container is in the form of a uni-dose.

According to one embodiment of the invention, the uni-dose comprises a dispenser equipped with a perforable sealing element.

BRIEF DESCRIPTION OF THE DRAWINGS

The aim, object and characteristics of the invention will become more clearly apparent on reading the following description with reference to the figures, wherein:

FIG. 1 shows a perspective view of an assembly composed of a container and a dispenser packaging according to the invention, FIG. 2 depicts a perspective view of the dispenser packaging and of the container, arranged beside one another, FIG. 3 illustrates a schematic view of the container being inserted into the dispenser packaging, FIG. 4 shows a sectional overview of an assembly composed of a container and a dispenser packaging according to the invention, FIG. 5 depicts a detailed view of the container before the perforable element of the dispenser packaging has been opened, FIG. 6 illustrates, in detail, the container dispenser packaging after said dispenser packaging has been opened, and FIG. 7 depicts a schematic view of filling the container according to the invention.

FIG. 1 shows a perspective view of the assembly 1 comprising a container (see FIG. 2) and a dispenser packaging 20. The objective of the assembly 1 is to allow the user to use a "uni-dose"-type container (as shown in FIG. 2) practically and hygienically. The dispenser packaging 20 may take on a decorative appearance, thus brightening up the use of said "uni-dose"-type container. As illustrated in FIG. 1, the dispenser packaging 20 comprises a first part 21, which is essentially cylindrical in shape. It should be noted that the embodiment depicted in FIGS. 1 to 7 illustrates a "uni-dose"-type container and a dispenser packaging 20 which is essentially cylindrical in shape. Of course, it is possible to envisage choosing any other shape, rectangular or other, while retaining the same advantages.

The first part 21, which forms the body of the dispenser packaging 20, comprises a window or flexible element 25. According to the example illustrated in FIGS. 1 to 5, thanks to the presence of the window 25, the user can directly deform the container present inside the dispenser packaging 20, which is described in greater detail below. According to an alternative embodiment that is not shown in the figures, a flexible element may be positioned in place of the window 25, this flexible element enabling deformation of at least part of the first part 21.

The dispenser packaging 20 comprises a second part in the form of a plug 22 fixed, for example, using a thread onto one end of the first part 21 of the dispenser packaging 20. The container present inside the dispenser packaging 20 may be sealed thanks to said plug 22. The details of said sealing are illustrated in FIG. 4.

The dispenser packaging 20 comprises a third element, in the form of a sealing element 23, which may be fixed inside the end of the first part 21 of the dispenser packaging 20. The sealing element 23 may be used to fix a container inside the dispenser packaging 20 once said container has been inserted into the first part 21 of said dispenser packaging 20. The assembly of the various elements is explained in greater detail in FIGS. 2 and 3.

As illustrated in FIG. 1, when the container is inserted into the dispenser packaging 20, the user sees only the outside of said dispenser packaging 20. According to the example illustrated in FIGS. 1 to 7, said dispenser packaging 20 is a reusable element. The container 10, which is designed to be inserted into the dispenser packaging 20, is a "disposable"-type container 10. This is why it is possible to have a dispenser packaging 20 with options, such as decorations, which can brighten up the appearance of the assembly 1. The use of so-called "precious" materials may be envisaged because the dispenser packaging 20 is reusable.

FIG. 2 shows the dispenser packaging 20, the side of which is equipped with the container 10 which is suitable for being inserted into it. For the sake of clarity, the sealing element 23 is illustrated in an "unscrewed" position.

According to FIG. 2, the container 10 is in the form of a "uni-dose", which is, generally, made of a flexible material. The container 10, which is essentially cylindrical in shape has, at a first end, a dispenser 11 and has a second end sealed by means of a base 12. The end of the dispenser 11 is sealed by means of a perforable sealing element 13. The "uni-dose"-type container 10 as illustrated in FIG. 2 is known from the prior art. The container 10 is particularly suitable for containing a pharmaceutical-type or cosmetic-type fluid. Just before it is used, the user inserts the container 10 into the dispenser packaging 20 and, by closing said dispenser packaging 20, the perforable element 13 of the container 10 is automatically perforated, as is explained in greater detail with reference to FIGS. 5 and 6 below. When the perforable sealing element 13 is perforated, the user can dispense a quantity of fluid by deforming the outer wall of the container 10.

Contrary to the conventional use of a container 10, the user does not use the container 10 in its "bare" form but rather previously inserts said container 10 into the dispenser packaging 20. The assembly of the dispenser packaging 20 and the advantages of its use are described in greater detail in FIG. 3.

FIG. 3 schematically illustrates the assembly of the dispenser packaging 20 and the container 10. The user must firstly insert the container 10 into the first part 21 of the dispenser packaging 20, as depicted in FIG. 3. After the container 10 has been inserted into the first part 21 of the dispenser packaging 20, the sealing element 23 is used to fix the container 10 in the dispenser packaging 20. When assembly is complete, the assembly 1 composed of the container 10 and the dispenser packaging 20 is ready to be used. To use the assembly 1, the user must firstly remove the plug 22 to thus release the dispenser 11 from the container 10. Then, by pressing on the flexible element 25 of the first part 21, the user can exert pressure onto the outside of said container 10 in order to deform it and thus make it possible for the dispenser 11 to dispense the fluid present inside said container 10. If the first part 21 is equipped with a window in place of a flexible element 25, the user can then directly exert pressure onto the outside of the container 10. When a sufficient quantity of fluid has been dispensed out of the container 10, the user can reposition the plug 22 on the dispenser packaging 20, once again sealing the dispenser 11.

FIG. 4 depicts a cross-sectional view of the assembly 1 according to the invention and shows that the flexible element 25, as part of the first part 21 of the dispenser packaging 20, allows the user to deform said flexible element 25 and the outer wall of the container 10. Furthermore, FIG. 4 illustrates the plug 22, the interior of which accommodates a sealing piece 26 specifically designed to close off the dispenser 11 of the container 10. The sealing piece 26 co-operates with a first cylindrical element 27 which surrounds the outside of the end of the dispenser 11 of said container 10. Thus, the end of said dispenser 11 is optimally sealed once the plug 22 is positioned on the dispenser packaging 20.

It should be noted that the present description refers to the fact that at least part of the flexible wall of the container 10 "remains accessible". This expression signifies that a user can either deform the container 10 by directly touching the outside of said container 10, or deform the container 10 by deforming part of the dispenser packaging 20.

FIG. 5 depicts a detailed view of the end of the first part 21 of the dispenser packaging 20 before the step of perforating the perforable sealing element 13 of the container 10. The end of the first part 21 of the dispenser packaging 20 comprises first cylindrical element 27 designed on the one hand to form the outlet of said first part 21 of said dispenser packaging 20 to allow the fluid contained inside the container 10 to be dispensed out of the assembly 1. A striker 28 is present inside of first cylindrical element 27, which is designed to co-operate with the perforable sealing element 13 of the container 10. With reference to FIGS. 3 and 4, when the container 10 is positioned inside the dispenser packaging 20, the perforable sealing element 13 comes into contact with the striker 28. By screwing the sealing element 23 onto the first part 21 of the dispenser packaging 20, the container 10, completely inserted into said first part 21 of said dispenser packaging 20, is pushed in the direction of the striker 28. When the sealing element 23 is completely fixed on the first part 21 of the dispenser packaging 20, the container 10 is completely inserted into said first part 21 of the dispenser packaging 20 and the perforable sealing element 13 is struck by the striker 28, as depicted in FIG. 6.

It appears clear that the perforation of the perforable sealing element 13 is performed automatically by the striker 28 during the assembly of assembly 1 according to the present invention. Furthermore, the user comes into contact neither with the dispenser 11 of the container 10, nor with the perforable sealing element 13 of said container 10. As illustrated in FIGS. 5 and 6, perforating the perforable sealing element 13 makes it possible to open the container 10 without pieces becoming detached from said container 10. In other words, opening the container 10 does not create any undesirable litter.

As depicted in FIGS. 5 and 6, when the container 10 is opened by means of the striker 28, the plug 22 prevents the fluid from exiting accidentally. This functionality may be ensured by the sealing piece 26 present inside the plug 22. In addition to the sealing piece 26, the plug 22 is equipped with a second cylindrical element 29 surrounding the end of first cylindrical element 27, both of which guarantee optimal leak-tight sealing of the end of first cylindrical element 27 of the first part 21 of the dispenser packaging 20, thus guaranteeing the sealing of the dispenser 11 of the container 10.

FIG. 7 shows a schematic view of filling the container 10, this container 10 comprising a first part 15 which has the shape of a bottle. Said first part 15 of the container 10 comprises an opening 17 for filling the container 10. When said first part 15 of the container 10 has been filled, the opening 17 is sealed by the second part 16 of said container 10. Said second part 16 of the container 10 comprises the dispenser 11 and the perforable sealing element 13. It is clear that FIG. 5 illustrates a specific embodiment. Any other suitable embodiment may also be used in combination with the dispenser packaging 20 as described above.

FIG. 5 shows that the first part 15 of the container 10 is equipped with protrusions 19, two of them being depicted, which can be used in combination with the inside of the sealing element 23 of the dispenser packaging 20 in order to facilitate extraction of the container 10 from the dispenser packaging 20 after it has been used. In order to obtain this result, the protrusions 19, as illustrated in FIG. 5, co-operate with the stops (not visible in the figures) present inside the interior wall of the sealing element 23.

The assembly 1 as described in FIGS. 1 to 5 allows the user to use a "uni-dose"-type container 10, comprising a perforable sealing element 13, hygienically and without causing any contamination. When the perforable sealing element 13 is removed, the user no longer has to press his/her fingers on the end of the dispenser 11 or any other location situated close to said end. By means of the plug 22 equipped with sealing elements, the container 10 can be securely reclosed, after a first use, while avoiding any contamination of the contents of the container 10.

As described above, using a dispenser packaging 20 furthermore offers the option of obtaining an assembly 1 with a decorative appearance.

The invention claimed is:

1. An assembly (1) comprising a container (10) adapted for containing a fluid, said container comprising a first end allowing the fluid to exit the container and a second end, and a dispenser packaging (20) which allows receiving said container (10) and envelop said container, at least partially, said container (10) comprising a dispenser (11) at the first end of said container (10) and the dispenser having a first end for allowing the fluid to exit the container (10) and at least one flexible wall, the container (10) being suitable for dispensing the fluid by means of the dispenser (11) by deforming said at least one flexible wall, the dispenser packaging (20) being suitable so that part of said at least one flexible wall is accessible from outside of said dispenser packaging (20) when the container (10) is placed inside said dispenser packaging (20), wherein the dispenser packaging (20) comprises at least a first element, suitable for partially enveloping the container (10) such that the dispenser (11) of the container (10) remains free in order to enable the fluid to be dispensed from the dispenser (11) to a user, and a second element suitable for sealing the dispenser (11) of the container (10), said second element of the dispenser packaging (20) being suitable to be fixed onto the first element of said dispenser packaging (20), wherein the first element (21) of the dispenser packaging (20) comprises an element (27) for surrounding the dispenser (11) of the container (10), wherein said first end of the dispenser (11) is equipped with a perforable sealing element (13), and wherein the element (27) for surrounding said dispenser (11) comprises a striker (28) suitable for perforating said perforable sealing element (13).

2. The assembly according to claim 1, wherein the second element of the dispenser packaging (20) is in the form of a plug (22).

3. The assembly according to claim 2, wherein the interior of the plug (22) comprises a sealing piece (26) suitable for sealing the dispenser (11) of the container (10).

4. The assembly according to claim 1, wherein the container (10) is in the form of a cylinder.

5. The assembly according to claim 4, wherein the first element of the dispenser packaging (20) is in the form of a cylinder, equipped with a first end which is open in order to allow the container (10) to be inserted into said first element, and a second end suitable for making the dispenser (11) protrude from the first element.

6. The assembly according to claim 5, wherein the second element of the dispenser packaging (20) comprises a sealing element (23) suitable for sealing said first end of the dispenser packaging (20) once the container (10) has penetrated the dispenser packaging (20).

7. The assembly (1) according to claim 4, wherein the container comprises at the second end of the container (10) opposite the dispenser (11), at least one protrusion which allows facilitating the extraction of said container (10) from the dispenser packaging after the container (10) has been used.

8. The assembly (1) according to claim 1, wherein the container (10) is in the form of a uni-dose.

9. The assembly (1) according to claim 8, wherein the uni-dose comprises a dispenser (11) equipped with a perforable sealing element (13).

* * * * *